US007559312B2

(12) United States Patent
Brauneis et al.

(10) Patent No.: US 7,559,312 B2
(45) Date of Patent: Jul. 14, 2009

(54) SEALING DEVICE FOR A FUEL INJECTOR, AND SEALING METHOD

(75) Inventors: Roman Brauneis, Bonn (DE); Dejan Jovovic, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/816,147

(22) PCT Filed: Feb. 15, 2006

(86) PCT No.: PCT/EP2006/001381

§ 371 (c)(1),
(2), (4) Date: Sep. 12, 2007

(87) PCT Pub. No.: WO2006/087186

PCT Pub. Date: Aug. 24, 2006

(65) Prior Publication Data

US 2008/0156298 A1 Jul. 3, 2008

(30) Foreign Application Priority Data

Feb. 15, 2005 (DE) ..... 10 2005 006 818

(51) Int. Cl.
*F02M 61/14* (2006.01)

(52) U.S. Cl. ..... 123/470

(58) Field of Classification Search ..... 123/470; 277/591, 641, 644; 239/533.11, 600
See application file for complete search history.

(56) References Cited

U.S. PATENT DOCUMENTS 3,334,617 A * 8/1967 Palkowsky ..... 123/470
3,776,209 A * 12/1973 Wertheimer et al. ..... 123/470
3,841,277 A * 10/1974 Schafer ..... 123/470
4,528,959 A * 7/1985 Hauser, Jr. ..... 123/470
4,589,596 A * 5/1986 Stumpp et al. ..... 239/397.5
4,647,012 A * 3/1987 Gartner ..... 251/148
4,829,965 A * 5/1989 Gartner et al. ..... 123/470
5,044,340 A * 9/1991 Robnett ..... 123/470
5,724,946 A * 3/1998 Franchitto ..... 123/470
6,186,123 B1 * 2/2001 Maier et al. ..... 123/470
6,196,195 B1 * 3/2001 Trutschel et al. ..... 123/470
6,615,802 B2 * 9/2003 Reiter et al. ..... 123/470
6,892,707 B2 * 5/2005 Reiter et al. ..... 123/470
6,921,033 B2 * 7/2005 Reiter ..... 239/533.2

(Continued)

FOREIGN PATENT DOCUMENTS

DE 10027669 12/2001

(Continued)

OTHER PUBLICATIONS

Search Report and Written Opinion for Application No. PCT/EP2006/001381 (16 pages).

*Primary Examiner*—Thomas N Moulis
(74) *Attorney, Agent, or Firm*—King & Spalding L.L.P.

(57) ABSTRACT

In order to create a fluid-tight seal relative to a seal seat edge (422), especially a cylinder head (40), in a sealing device for a fuel injector (1), particularly for a nozzle retaining nut (10) of the fuel injector (1), the sealing device has a sealing area (12) that is provided with a concave zone (122) having a radially circumferential concave outer contour (124) which can be made to sealingly rest against the seal seat edge (422).

20 Claims, 7 Drawing Sheets

U.S. PATENT DOCUMENTS

| | | | | |
|---|---|---|---|---|
| 7,004,476 | B2 * | 2/2006 | Nakayama et al. | 277/591 |
| 7,293,550 | B2 * | 11/2007 | Beardmore | 123/470 |
| 7,373,925 | B2 * | 5/2008 | Reiter et al. | 123/470 |

FOREIGN PATENT DOCUMENTS

| | | |
|---|---|---|
| DE | 10102192 | 11/2002 |
| EP | 1422418 | 5/2004 |
| GB | 2022727 | 12/1979 |
| JP | 08246994 | 9/1996 |
| WO | 01/94775 | 12/2001 |

* cited by examiner

SEALING DEVICE FOR A FUEL INJECTOR, AND SEALING METHOD

CROSS-REFERENCE TO RELATED APPLICATIONS

This application is a U.S. national stage application of International Application No. PCT/EP2006/001381 filed Feb. 15, 2006, which designates the United States of America, and claims priority to German application number 10 2005 006 818.9 filed Feb. 15, 2005, the contents of which are hereby incorporated by reference in their entirety.

TECHNICAL FIELD

The invention relates to a sealing device for a fuel injector, in particular a sealing device for a nozzle retaining nut of the fuel injector, in order to ensure a fluid-tight connection between the fuel injector and a cylinder head. The invention also relates to a method for the fluid-tight sealing of a component of a fuel injector to a cylinder head.

BACKGROUND

A nozzle retaining nut holds the two main components of a fuel injector—an injection nozzle and a valve body—tightly together. In the installed state of the fuel injector in the cylinder head, the injection nozzle projects into a combustion chamber of a motor vehicle engine, the valve body arranged above the injection nozzle actuating the injection nozzle. For this purpose it is necessary to seal the fuel injector against the cylinder head relative to the combustion chamber. This is effected by a suitable configuration of the nozzle retaining nut, which cooperates with a corresponding device, a seal seat, in the cylinder head.

High demands are placed on such a sealing arrangement. Firstly, the sealing arrangement is exposed to high thermal stresses (−40° C. when cold-starting in winter, to above +150° C. under operating conditions) and, secondly, the sealing device is subjected to high mechanical stresses, in particular vibration stresses. In addition, the sealing arrangement must ensure a permanently sealed state between fuel injector and cylinder head which can withstand long-duration stresses.

For this purpose, in the prior art, a horizontal edge, for example, is formed on the nozzle retaining nut, which seats on a likewise horizontal edge provided in the injector bore, and the nozzle retaining nut and the fuel injector are pressed against the cylinder head with a large static force. A permanently fluid-tight connection between the two edges is claimed is to be created by the provision of a large-area overlap.

With such an arrangement both sealing faces must be very accurately machined in order to obtain any lastingly fluid-tight connection. Because of the lateral clearance between fuel injector and injector bore which must be provided, centering between fuel injector and injector bore is not possible with this configuration, so that the centering must be effected by means of other arrangements or devices.

In DE 101 02 192 A1 a nozzle retaining nut has on a free end a tapered zone which is insertable in a corresponding tapered section of the injector bore. In the pre-assembled state, that is, when the fuel injector with nozzle retaining nut is inserted in the tapered injector bore, a circumferential angular difference from 2° to not more than 5° is present between the taper on the nozzle retaining nut and the tapered bore in the cylinder head. This ensures centering of the fuel injector in the injector bore, the fuel injector then being pressed into the bore with a large static force and a common sealing face being formed between the taper on the nozzle retaining nut and the conical bore in the cylinder head.

Because the angular difference between the taper on the nozzle retaining nut and the tapered bore in the cylinder head is only 2° to 5°, a large overlap area between the two sealing faces exists in the pre-assembled state, so that, because of a jamming effect between the two sealing faces, self-centering is effected in only an unsatisfactory manner. This problem is countered in the prior art by surface-coating of the corresponding surfaces, in particular that of the nozzle retaining nut, in order to reduce the coefficient of sliding friction between nozzle retaining nut and injector bore.

Despite the improvement of sliding friction between fuel injector and injector bore, the angular difference of 2° to 5° is too small to prevent jamming and to ensure self-centering. Through increasing the angular difference between the taper on the nozzle retaining nut and the tapered bore in the cylinder head to above 5°, an impairment of subsequent sealing quality would be incurred, which can lead to leakage during operation of the fuel injector.

SUMMARY

According to an embodiment, a sealing device for a fuel injector, in particular for a nozzle retaining nut of the fuel injector, for fluid-tight sealing with respect to a seal seat edge, in particular a cylinder head, may comprise a sealing area, the sealing area having a concave zone with a radial, circumferential, concave outer contour which can be brought into sealing abutment against the seal seat edge.

Such a fuel injector has good self-centering during installation of the fuel injector in the cylinder head and establishes in cooperation with the cylinder head a permanently fluid-tight connection between fuel injector and cylinder head.

According to another embodiment a fuel injector may comprise such a sealing device. According to yet another embodiment a motor vehicle, an engine or a cylinder head may comprise such a fuel injector, wherein the concave zone of the nozzle retaining nut is seated on the rim of the seal seat edge of the cylinder bore.

According to yet another embodiment, a method for centering and permanently sealing in a high pressure-resistant, fluid-tight manner a first component of a fuel injector with respect to a sealing area of a second component, wherein the first component has a concave zone and the second component has a seal seat edge, may comprising the steps of: for a pre-assembled state of the two components placing the concave zone against the seal seat edge for centering the two components with respect to one another, and when putting the two components into an assembled state, impressing at least one section of the concave zone in the seal seat edge by an at least elastic deformation of the material of the second component wherein the two components thus form a fluid-tight seal.

BRIEF DESCRIPTION OF THE DRAWINGS

The invention is explained below with reference to embodiments and to the appended drawings, in which.

DETAILED DESCRIPTION

Figure 1B:
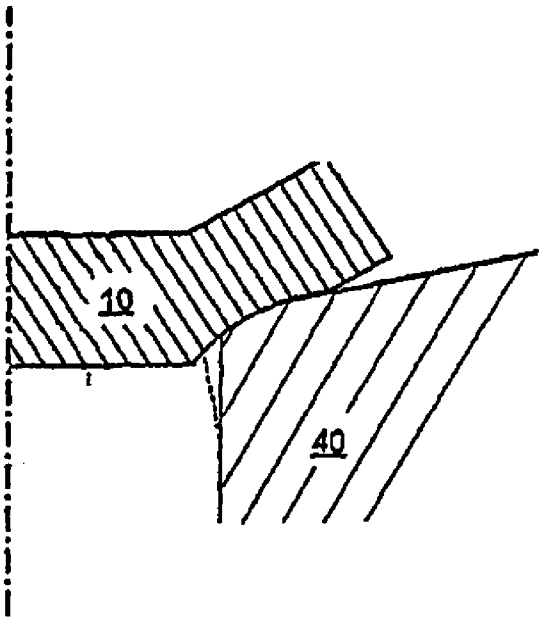
FIG. 1*b* shows the sealing arrangement from FIG. 1*a* in the assembled state.

According to an embodiment, in a sealing device or sealing arrangement for a cylinder head and a fuel injector, in particular for a nozzle retaining nut of the fuel injector and the cylinder head, the one component has a radial, preferably completely circumferential, concave cross-sectional profile extending in a longitudinal direction, which profile can be placed against/impressed into a sealing face or sealing edge of a second component. In this arrangement the nozzle retaining nut of the fuel injector can be preferably configured with a radial and completely circumferential concave chamfer. A seal seat edge, disposed horizontally or conically at an angle, can be formed inside a stepped injector bore.

The concave chamfer and the sealing rim of the seal seat edge cooperate in a particular manner. In a pre-assembled or centered state, the fuel injector can be inserted with its nozzle retaining nut in the injector bore without any artificial forces acting on the fuel injector. The dimensions of the nozzle retaining nut and of the injector bore can be selected such that the concave zone or concave chamfer of the nozzle retaining nut seats against the sealing rim of the seal seat edge. A kinematic reversal, that is, injector bore with concave chamfer and nozzle retaining nut with preferably tapered seal seat edge, is naturally also possible. The materials from which the components are manufactured may also be optionally exchanged for one another, or consideration must be given to their selection. The concave chamfer of the nozzle retaining nut can be seated with only a circle or a thin annulus (centered state) against the rim of the seal seat edge, so that the nozzle retaining nut cannot jam in the injector bore. Because of a low friction between nozzle retaining nut and cylinder head, the fuel injector aligns itself in a self-centering manner in the injector bore. The concave chamfer preferably may have a coefficient of adhesion and/or sliding friction as low as possible, whereby self-centering is further facilitated.

The sealed state between fuel injector and cylinder head can then be adopted. In this state the fuel injector can be pressed with a large static force into the injector bore or against the seal seat formed in the bore, whereby the concave zone, which is preferably harder relative to the cylinder head, preferably plastically deforms the seal seat edge and is pressed into the seal seat edge such that a fluid-tight connection between nozzle retaining nut and cylinder head is established.

As a result of the deformation of the seal seat edge of the injector bore, a planar sealing section can be formed between nozzle retaining nut and cylinder head, the seal seat edge being adapted to the concave chamfer as a result of the plastic deformation of the former, and permanent fluid-tightness with high surface pressure being established between fuel injector and cylinder head. Furthermore, it is thereby made possible to compensate unevenness and small depressions in the surfaces. Such arrangements are permanently resistant to pressure infiltration, so that a sealing arrangement highly resistant to thermal and mechanical stresses combined with permanent fluid-tightness is produced.

In an embodiment, the angle, in the centered state, between a tangent at a point of contact between seal seat edge and concave chamfer, and the seal seat edge extending radially outwards, is approximately 10°, whereby good self-centering of the fuel injector in the cylinder head is achieved. During tightening of the fuel injector in the cylinder head, when deformation of the seal seat edge occurs, a tangent angle of a radially outermost point of contact between concave chamfer and seal seat edge changes to the value of 2° to 5° usual in the prior art. The cylinder head or seal seat edge are usually made of aluminum or magnesium.

Through additional surface treatment of the concave chamfer, improved sliding properties of the nozzle retaining nut with respect to the sealing seat edge, or to its rim, are produced in this area, so that the fuel injector positions itself rapidly and with correct orientation with respect to the cylinder head in a simple manner.

As a result of the provision of the concave chamfer, increased specific surface pressure is produced especially in the radial area of the seal seat edge located further inwards, whereby sealing between fuel injector and cylinder head is improved as compared to the prior art. The highest surface pressure occurs on the inner area of the seal seat edge, on which the internal pressure of the combustion chamber also impinges; this is especially advantageous because pressure infiltration can be effectively countered. Furthermore, as the concave chamfer is impressed into the seal seat edge of the injector bore, the tension gradient in the cylinder head is more favorable, as compared to the prior art, whereby fewer fissures are produced in the cylinder head, increasing the durability thereof. Conversely, the induction of force into the nozzle retaining nut is also optimized, as compared to the prior art, likewise resulting in a more favorable tension gradient within the nozzle retaining nut.

In another embodiment, a straight connecting line which, in the centered state, passes through the point of contact of the concave chamfer with the seal seat edge and through a circumferential point on the external diameter of the concave zone (the two points on the straight line and a longitudinal axis of the nozzle retaining nut lie in one plane) includes with a corresponding diametrically opposite straight line an angle of preferably approximately 108° or approximately 110°. In this case the radius of the preferably arcuate concave chamfer is 55 mm±20 mm, in particular 55 mm±5 mm.

A motor vehicle, an engine or a cylinder head may have a fuel injector according to various embodiment, or a fuel injector with a nozzle retaining nut according to various embodiments.

According to another embodiment, in a method for centering and fluidically sealing two components, in particular for centering and fluidically sealing a fuel injector or a nozzle retaining nut with respect to a cylinder head, the first component has a radial and preferably completely circumferential concave zone which, for a pre-assembled state, is placed against a seal seat edge of the second component for centering the two components with respect to one another. When the two components are put into an assembled state, the concave zone moves into the second component, while the material of the seal seat edge is elastically, but preferably plastically, deformed, in such a way that a common sealing face between concave zone and seal seat edge is produced as a result of surface pressure, which common sealing face is fluid-tight even at high internal pressures.

When positional references such as "top"/"above" or "bottom"/"below", and "right" or "left" are given in what follows, they relate to FIG. 2, in which a nozzle retaining nut 10 is shown in a sectional view on the right and in a non-sectional view on the left, the nozzle retaining nut 10 clamping an injection nozzle 20 arranged below to a valve body 30 arranged above.

Figure 1A:
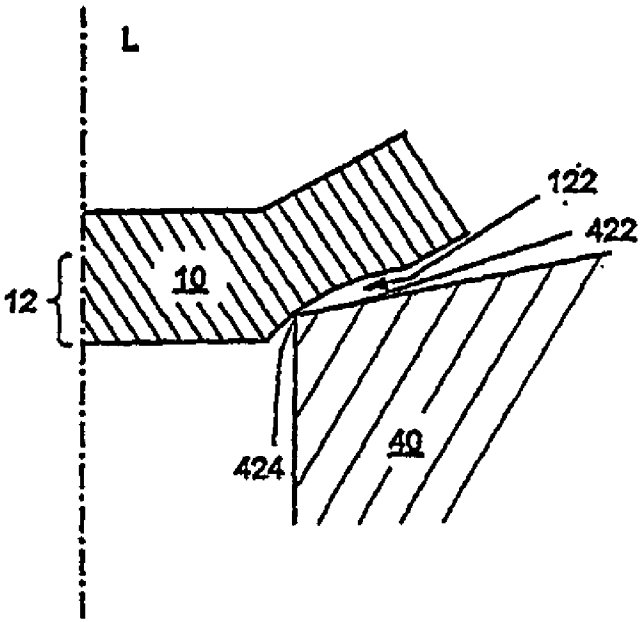
FIG. 1*a* shows an sealing arrangement in the pre-assembled state.

FIGS. 1*a* and 1*b* show a sealing arrangement according to an embodiment, in particular for providing a permanent and high pressure-tight fluid seal between two components 10 and 40, for example a nozzle retaining nut 10 and a cylinder head 40.

FIG. 1*a* represents a pre-assembled state of the two components 10, 40, the component 10 preferably being self-centered with respect to the component 40, for which reason this pre-assembled state is also called the centered state. However, self-centering of the two components 10, 40 with respect to one another is not essential; it is sufficient if the first component 10 can be placed against the second component 40, without reciprocal self-centering. However, if reciprocal centering is necessary, but self-centering is not possible, it should be effected with external means.

For centering and sealing, the first component 10 has a concave zone 122 and the second component 40 a seal seat edge 422. In the pre-assembled state of the two components 10, 40, the central section of the concave zone 122 rests against the rim 424 of the seal seat edge 422. In FIGS. 1*a* and 1*b* the central section of the concave zone 122 can be seen only as a point or small area (point of contact between concave zone 122 and seal seat edge 422); for the preferably rotationally symmetrical component 10, however, the central section is in idealized form a circle or a thin annulus. Seating of the smallest diameter of the concave zone 122 (lower edge of component 10) on the seal seat edge 422 (cf. FIGS. 5*a* and *b*) is also possible (further embodiment).

In a sealed state of the two components 10, 40, represented in FIG. 1*b*, a section of the concave zone 122 is imprinted or impressed, with an at least elastic, preferably plastic, deformation of the material of the second component 40, in the seal seat edge 422. The impressing of the first component 10 in the second component 40 takes place on a section of the rim 424 of the seal seat edge 422 disposed radially outwardly from a longitudinal axis L of the sealing arrangement. The deformation of the second component 40 is indicated by means of a broken line in FIG. 1*b*. By means of this upper portion bulging radially inwardly along the concave zone 122, the sealing area between the two components 10, 40 is additionally enlarged, increasing the fluid-tightness of the two components 10, 40.

Figure 2:
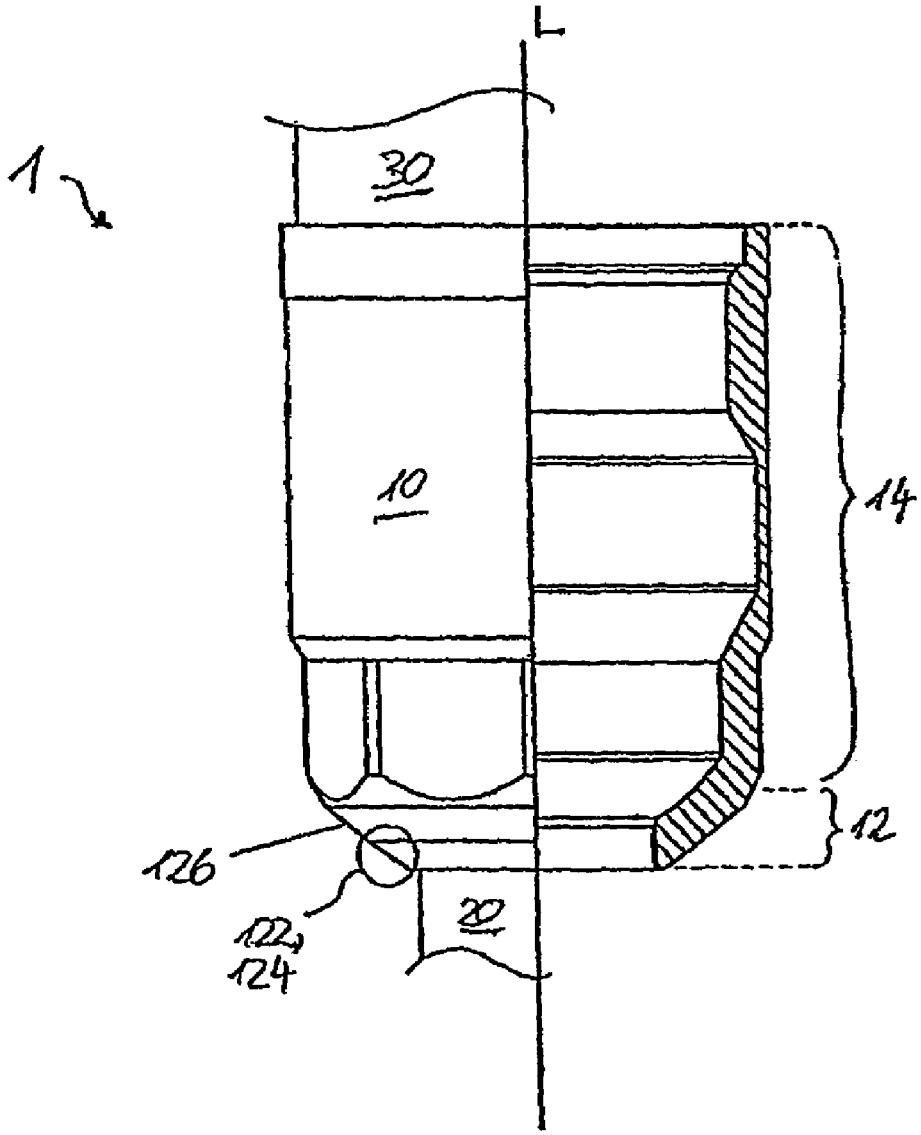
FIG. 2 shows a nozzle retaining nut with an sealing device.
Figure 3A:
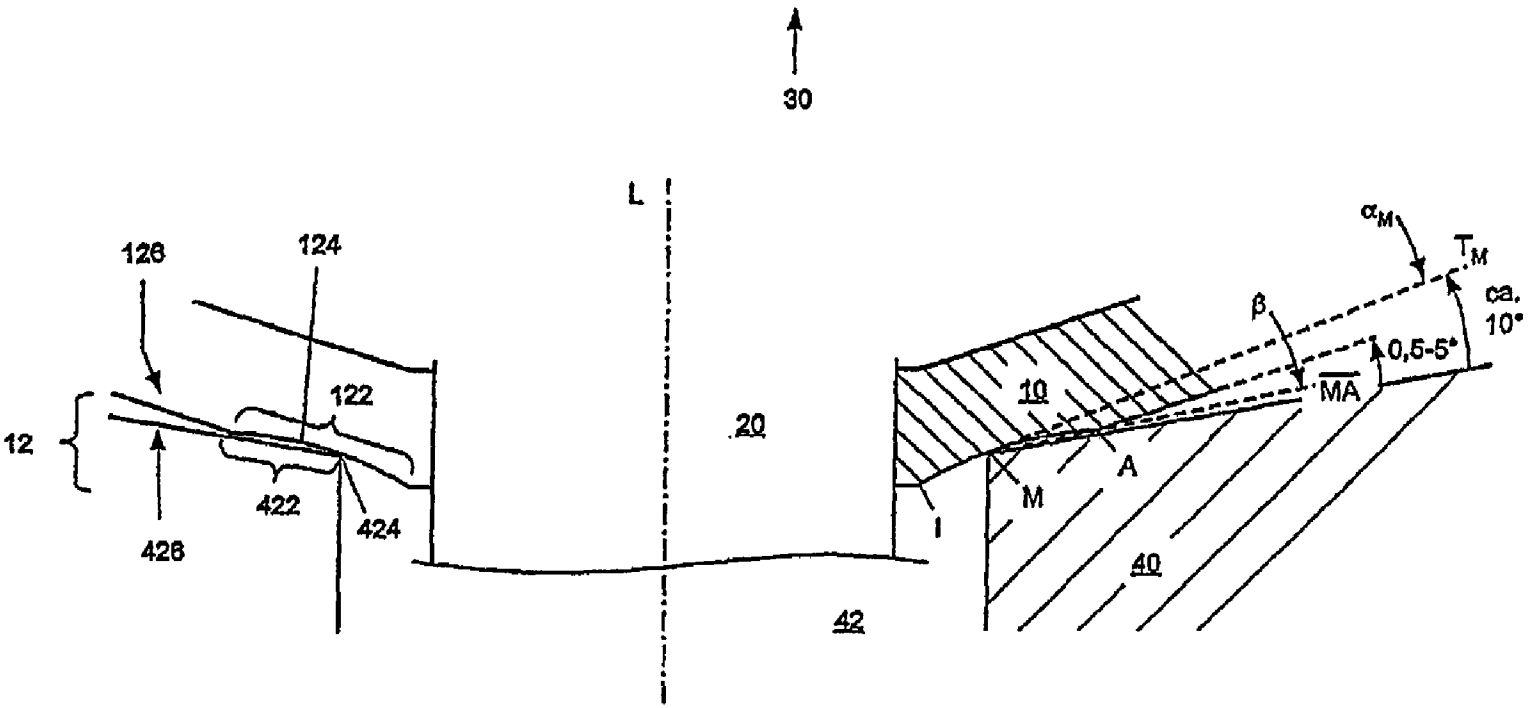
FIG. 3*a* shows the sealing device from FIG. 2 in a centered state with a cylinder head in partial section.
Figure 3B:
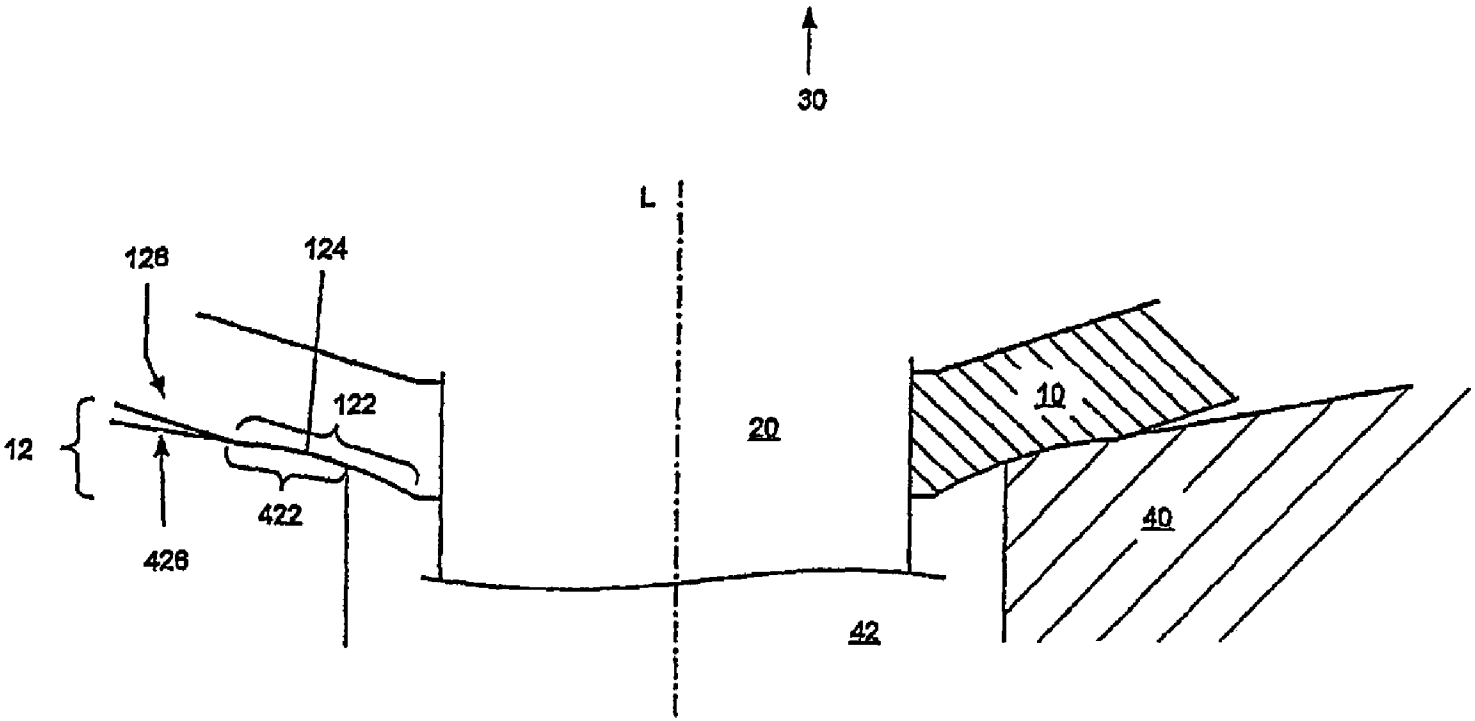
FIG. 3*b* shows the sealing device from FIG. 2 in the sealed state with the cylinder head.
Figure 4:
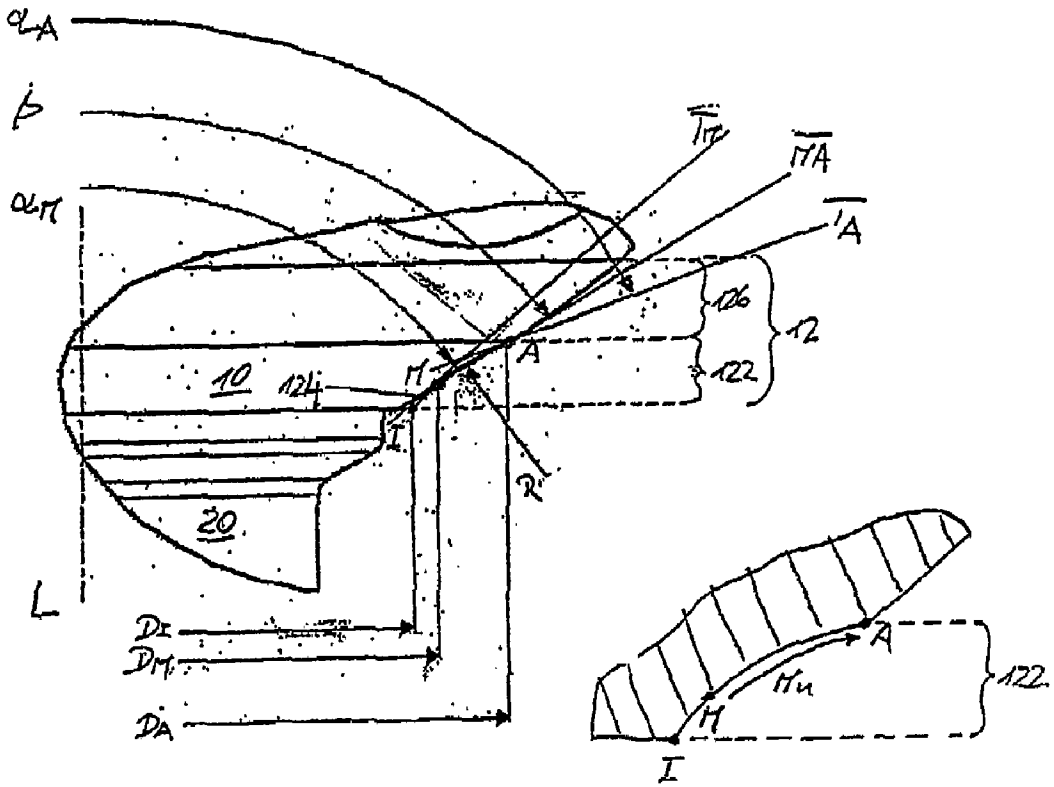
FIG. 4 shows the sealing area of the nozzle retaining nut from FIG. 2 in an enlarged representation, and an additional detail in section.

FIGS. 2 to 4 show a first embodiment of the sealing arrangement, the sealing arrangement being embodied on a nozzle retaining nut 10 and a cylinder head 40 associated therewith. The sealing arrangement serves to seal a fuel injector 1, preferably via its nozzle retaining nut 10, in an injector bore 42 of the cylinder head 40 with respect to a combustion chamber of an internal combustion engine.

The sealing device is located preferably on the lower free end of the nozzle retaining nut 10 which clamps together an injection nozzle 20 and a valve body 30 and combines them to form a fuel injector 1 (see FIG. 2); however, the sealing device may also be provided on the fuel injector 1 itself, in which case the nozzle retaining nut 10 performs no sealing functions, or only other sealing functions, for the fuel injector 1. This first embodiment of the sealing device on the nozzle retaining nut 10 comes into abutment with a seal seat in the injector bore 42 (FIGS. 3*a* and 3*b*), sealing device and seal seat core cooperating together according to the principle of the various embodiments as shown in FIGS. 1*a* and 1*b*.

In the embodiment, a sealing and centering zone 12 of the nozzle retaining nut 10 is preferably formed in two sections. In this case a tapered zone 126 coming from below adjoins a concave zone 122 on the nozzle retaining nut 10. Concave zone 122 and tapered zone 126 are used for inserting the nozzle retaining nut 10 and the fuel injector 1 in the injector bore 42 (FIGS. 3*a* and 3*b*), the concave zone 122 being designed to center the nozzle retaining nut 10 on a seal seat edge 422 of the injector bore 42 in the centered or pre-assembled state. The nozzle retaining nut 10 is preferably radially symmetrical, the concave zone 122 having a radially extending and completely circumferential concave chamfer 124, the cross-sectional profile of which extends upwardly in the longitudinal or axial direction L of the nozzle retaining nut 10. However, the nozzle retaining nut 10 may also be configured such that the tapered zone 126 is absent and only the concave zone 122 is present on the lower, substantially conical section of the nozzle retaining nut 10. A cylindrical portion 14 of the nozzle retaining nut 10, in which cylindrical portion 14 the valve body 30 is primarily received, adjoins the sealing area 12 of the nozzle retaining nut 10 at the top.

In the centered state of the nozzle retaining nut 10 and of the fuel injector 1, represented in FIG. 3*a*, the concave chamfer 124 and the concave zone 122 rest on a rim 424 of a seal seat edge 422. The rim 424 of the seal seat edge 422 describes substantially a circle or a thin annulus on the concave chamfer 124. The more circular (imagined in a plane) this section on the concave chamfer 124 is, the more truly centered is the nozzle retaining nut 10 in the injector bore 42 of the cylinder head 40.

The injector bore 42 is preferably a stepped circular-cylindrical bore the lower section of which, of smaller diameter, receives a section of the injection nozzle 20, and the upper section of which, of larger diameter, receives the nozzle retaining nut 10 of the fuel injector 1. Both zones are preferably connected via a cone or annular bevel (referred to hereinafter as the tapered zone 426); however, a horizontal step, which includes a right angle with the respective portion of the injector bore 42, is also possible.

In the centered state, the point of contact M (sectional representation in FIG. 3*a*), or the circle/annulus of contact M (real situation with the fuel injector 1 centered in the injector bore 42), of rim 424 and concave chamfer 124 lies between a circumferential point/circumferential circle/annulus I having the (lower) internal diameter $D_I$ (FIG. 4) of the concave chamfer 124, and a circumferential point/circumferential circle/annulus A having the (upper) external diameter $D_A$ of the concave chamfer 124, the point of contact M preferably lying within the first third or within the first half of the distance from circumferential point I to circumferential point A.

In what follows only the points M, I and A are referred to, and not the corresponding circles or annuli; however, the contact circles or contact annuli are also meant. Furthermore, in what follows geometrical references, for example angle values and references to positions of straight lines, relate to planes in which the longitudinal or axial axis L of the nozzle retaining nut 10 is contained; in particular, a plane to be considered coincides with the drawing plane of FIG. 4.

The seal seat edge 422 of the injector bore 42 is preferably an inner section of the tapered zone 426 of the injector bore 42, the tapered zone 426 having with the tapered zone 126 of the nozzle retaining nut 10 a circumferential aperture angle of approximately 0.5° to 5° (ideal centered state—the circle formed by all points M is perpendicular to L). Further angular relationships, as represented in FIG. 3*a*, are specified in the context of the explanation of FIG. 4.

FIG. 3*b* shows a sealed state of nozzle retaining nut 10 and cylinder head 40, the nozzle retaining nut 10 being impressed into the seal seat edge 422 of the injector bore 42 with preferably plastic deformation of the seal seat edge 422. In this case deformation of the inner seal seat edge 422 again preferably takes place towards the inside (cf. description of FIG. 1*b*). Ideally, an annular surface pressure with the greatest and most uniform possible annulus thickness and the highest possible surface pressure is generated, which has no points of uneven pressure. Preferably, the edge (A) of the external diameter of the concave chamfer 124 is not impressed, or only just is not impressed, in the tapered zone 426 or the seal seat edge 422.

FIG. 4 shows in detail the sealing area 12 of the nozzle retaining nut 10, which is divided into tapered zone 126 and concave zone 122. The tapered zone 126 and the concave zone 122 have a common circle which can be seen, inter alia, at point A in FIG. 4. This is at the same time a circumferential point A of the largest external diameter $D_A$ of the concave zone 122. If the concave zone 122 is now followed downwards (and inwards towards L) from point A of the concave chamfer 124, one moves on the concave chamfer 124 via the point of contact M of concave chamfer 124 and rim 424 (in the centered state) to the circumferential point I on the smallest internal diameter $D_I$ of the concave zone 122. In an embodiment, $D_A$=13 mm, the diameter $D_M$ of a circle formed from point M being approximately 10.9 mm in the centered state. In this case, as mentioned above, the point M is located on the first third or the first half of the distance from point I to point A.

The concave chamfer 124 is preferably in the form of an arc of a circle, the radius R of which may vary between 20 mm and 100 mm. In an embodiment the radius of the concave chamfer 124 is 55±5 mm. Correspondingly other radii are produced if the inventive concept is applied to other components; in principle, it is important that a concave contour is involved. Non-arcuate contours, which differ from a simple taper, are also possible according to various embodiments. In particular, constant transitions to the other regions of the nozzle retaining nut 10 at the edges of the concave chamfer at I and A are advantageous, as the tension gradient in the nozzle retaining nut 10, and the induction of force to the tapered zone 426 at the edges (I, A) of the cone chamfer 124, are more favorable and change less abruptly, for which purpose a clothoid, for example, is suitable.

The following angular values for the sealing device relate to an internal aperture angle of a cone which is formed by a straight line rotating around the longitudinal axis L of the nozzle retaining nut 10. Such a straight line $T_M$ is the tangent at the point M in the centered state of the nozzle retaining nut 10, the aperture angle $\alpha_M$ of the cone in the centered state being preferably from 104° to 110°, depending on the radius R of the concave chamfer 124. A corresponding angle $\alpha_A$ of the tangent $T_A$ at point A is preferably from 107° to 113°, again depending on the radius R of the concave chamfer 124. An angle β of a straight line MA connecting points M and A is preferably from 106° to 112°. All these values are related to a point M which is established in the centered state of the nozzle retaining nut 10. As the nozzle retaining nut 10 is impressed into the cylinder head 40, the point M begins to travel along the concave chamfer 124 in the direction of the point A (and, of course, linearly along the seal seat edge 422) (point Mn), a straight line MnA constantly approaching the tangent $T_A$. This is made clear in the sectional representation of the detail in FIG. 4. Here, Mn is a radially outermost point of contact between concave chamfer 124 and seal seat edge 422.

Further embodiments which derive from the above are specified in the table by the following parameters:

| | Cone angle of rotating straight connecting line MA | | | |
|---|---|---|---|---|
| | β = 108° | | β = 110° | |
| Ø [mm] | R = 35 | R = 85 | R = 35 | R = 85 |
| $D_M$ = 10.9 ($\alpha_M$) | 105.9° | 107.1° | 107.9° | 109.1° |
| $D_{Mn}$ = 12.0 ($\alpha_{Mn}$) | 108.1° | 108.0° | 110.1° | 110.0° |
| $D_A$ = 13.0 ($\alpha_A$) | 110.1° | 108.9° | 112.1° | 110.9° |

In the table the variables relate to FIG. 4, a value of Mn=12.0 mm between M and A on the concave chamfer 124, upon moving from M to A, being entered as an example in the table.

Figure 5A:
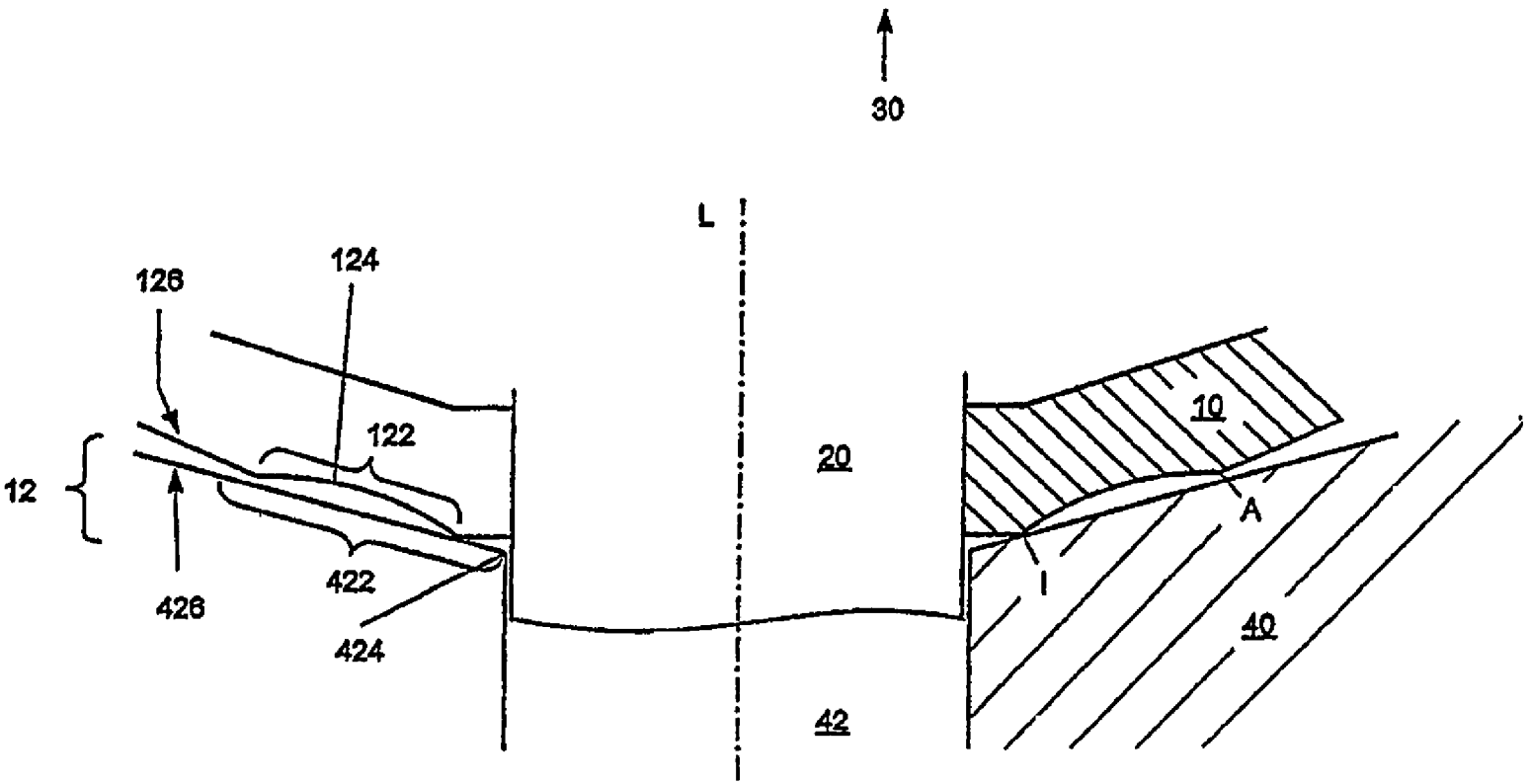
FIG. 5*a* shows a second embodiment of the sealing device in the centered state in partial section.

FIG. 5*a* shows a second embodiment of the sealing device for the fuel injector 1 or the nozzle retaining nut 10, in which it is not the concave chamfer 124 which centers on the rim 424 of the seal seat edge 422, but the lower edge on the seal seat edge 422. This has the advantage that the injector bore 42 can be configured with a smaller diameter and can extend closer to the injection nozzle 20 of the fuel injector 1. Optionally, only the upper edge of the concave chamfer 124 may rest on the seal seat edge 422 (circle/annulus A, largest diameter of concave chamfer 124). Furthermore, it is also possible that in the centered state both circular edges I and A rest on the seal seat edge 422, which arrangement has the advantage that a centered position of the two components can be monitored in that the centered position is adopted only when both circular edges I and A rest completely against the seal seat edge 422.

Figure 5B:
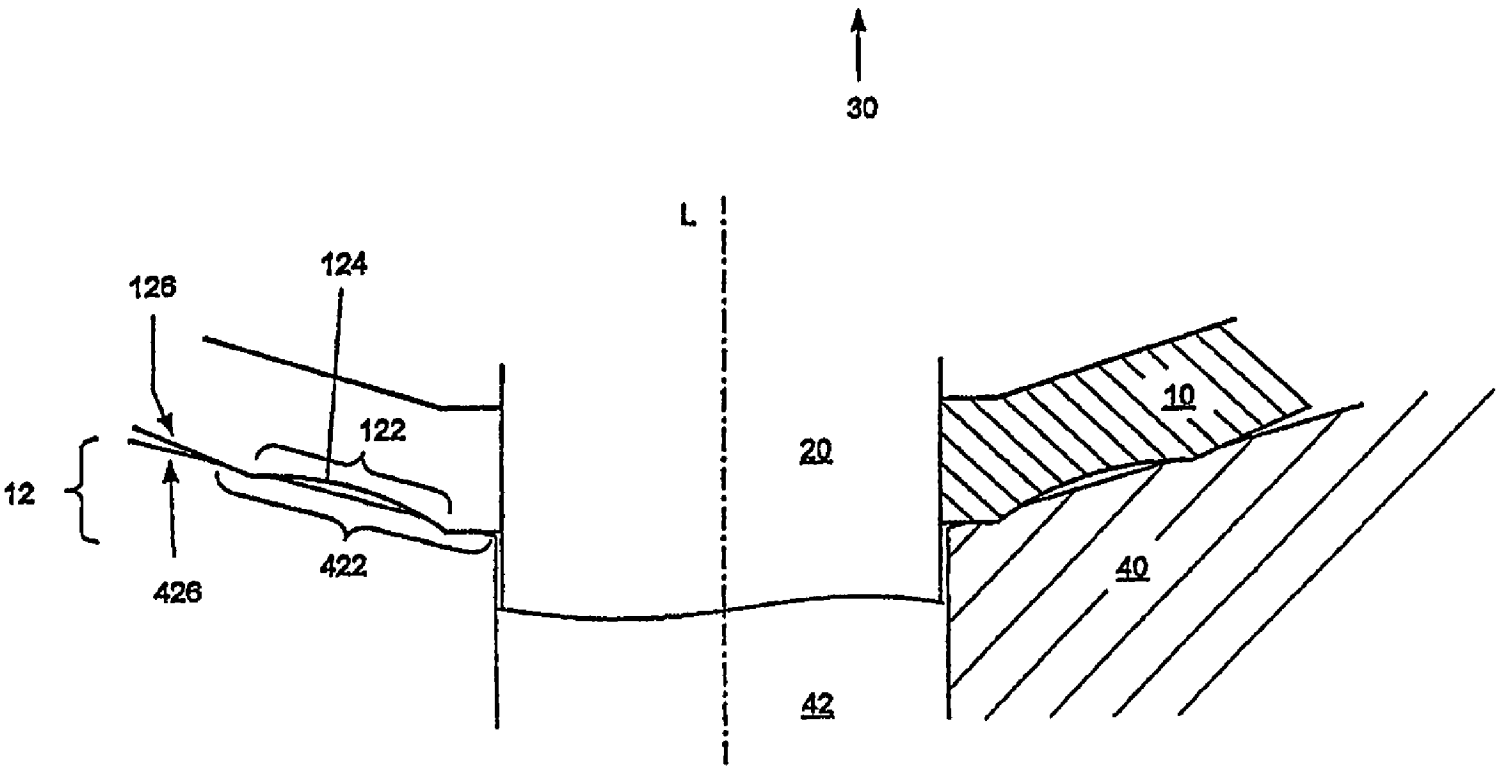
FIG. 5*b* shows the second embodiment of the sealing device from FIG. 5*a* in the sealed state.

The sealed state is shown in FIG. 5*b*, the two circles or annulus edges I and A being impressed in the seal seat edge 422 of the cylinder head 40 and forming two sealing zones, in the case illustrated. The more firmly the nozzle retaining nut 10 is impressed in the cylinder head 40, the smaller the gap remaining between nozzle retaining nut 10 and cylinder head 40 becomes. Other configurations of the sealed state are also possible, in which, for example, only the lower circular edge I or only the upper circular edge A is impressed in the seal seat edge 422.

No cavity preferably exists between nozzle retaining nut 10 and cylinder head 40. In implementing such a sealing arrangement it may be necessary to provide venting of the cavity initially present. This venting preferably occludes itself automatically through the impressing of the nozzle retaining nut 10 into the cylinder head 40. This may be effected, for example, by a groove in the cylinder head 40 or in the nozzle retaining nut 10, into which groove material of the nozzle retaining nut 10 or material of the cylinder head 40 penetrates during the impressing. Bores which are occludable in like manner are also suitable.

The preceding embodiments, which relate to the nozzle retaining nut 10, should also apply to the fuel injector 1 which is not sealed with respect to the cylinder head 40 by means of its nozzle retaining nut 10 but which has the device on another section. The device on the fuel injector 1 and a corresponding seal seat on or in the cylinder head then together form the sealing arrangement.

What is claimed is:

1. A sealing arrangement for a nozzle retaining nut of a fuel injector and a cylinder head, for fluid-tight sealing with respect to a seal seat edge, comprising a sealing area at the nozzle retaining nut or the cylinder head, wherein the sealing area comprises a concave zone with a radial, circumferential, concave outer contour operable to directly abut against the seal seat edge of the cylinder head or the nozzle retaining nut.

2. The sealing arrangement according to claim 1, wherein the concave zone is configured with a completely circumferential concave chamfer and a tapered zone disposed in a radial direction adjoins the concave zone.

3. The sealing arrangement according to claim 1, wherein in a centered state the concave zone is placed on the seal seat edge and a circumferential circular section of the concave chamfer rests on a rim of the seal seat edge.

4. The sealing arrangement according to claim 1, wherein in a sealed state the concave zone is firmly connected to the seal seat edge, the concave zone being impressed in the seal seat edge by an at least elastic, preferably plastic, deformation of the seal seat edge.

5. The sealing arrangement according to claim 2, wherein the concave chamfer is formed radially and circumferentially on a sealing face of the nozzle retaining nut, which sealing face is seated for abutment on a seal seat edge of an injector bore of the cylinder head.

6. The sealing arrangement according to claim 1, wherein in the centered state the angle between seal seat edge and a tangent on a point of contact of concave chamfer and rim is 14±2°, 10±1°, or 7±1°.

7. The sealing arrangement according to claim 1, wherein at least one section of the concave zone extending in the longitudinal direction of the fuel injector cooperates in the sealed state with the seal seat edge of the injector bore in such a way that the fuel injector is fixed in a fluid-tight manner with respect to the cylinder head.

8. The sealing arrangement according to claim 1, wherein in the sealed state the angle between the tangent on a radially outermost point of contact between concave chamfer and seal seat edge is 7±1°, 4±1°, or 2±0.5°.

9. The sealing arrangement according to claim 1, wherein the seal seat edge is configured as a tapered cone edge, the aperture angle of which is larger than an angle included by the tapered zone, the aperture angle between the two being 0.5° to 5°, or 1° to 4°, or 2±0.5°.

10. The sealing arrangement according to claim 1, wherein in the centered state a point of contact of concave chamfer and rim, and a point on the external diameter of the concave chamfer, form a straight connecting line which includes with the longitudinal axis of the fuel injector an angle from 50° to 60°, from 52° to 58°, from 53° to 56° or from 54° to 55°.

11. The sealing arrangement according to claim 1, wherein a profile of the concave chamfer is arcuate and has a radius of 30 mm to 90 mm, 45 mm to 65 mm, 50 mm to 60 mm or 55±2.5 mm.

12. The sealing arrangement according to claim 1, wherein the surface of the concave chamfer is polished, preferably by means of a shot-peening process.

13. The sealing arrangement according to claim 1, wherein the material of the seat seal edge, preferably aluminum, is softer than the material of the concave zone, which is preferably made of steel.

14. The sealing arrangement according to claim 1, wherein the inner contour disposed opposite the concave chamfer of the fuel injector or of the nozzle retaining nut is convex.

15. A fuel injector having a sealing arrangement for a nozzle retaining nut of the fuel injector and a cylinder head, for fluid-tight sealing with respect to a seal seat edge, comprising a sealing area at the nozzle retaining nut or the cylinder head, wherein the sealing area comprises a concave zone with a radial, circumferential, concave outer contour operable to directly abut against the seal seat edge of the cylinder head or the nozzle retaining nut.

16. A cylinder head with a fuel injector comprising a sealing arrangement for fluid-tight sealing with respect to a seal seat edge of a cylinder bore, wherein the fuel injector comprises a nozzle retaining nut with a sealing area, the sealing area having a concave zone with a radial, circumferential, concave outer contour operable to directly abut against the seal seat edge, wherein the concave zone of the nozzle retaining nut is seated on the rim of the seal seat edge of the cylinder bore.

17. A method for centering and permanently sealing in a high pressure-resistant, fluid-tight manner a nozzle retaining nut of a fuel injector with respect to a sealing area of a cylinder head, wherein the nozzle retaining nut has a concave zone and the cylinder head has a seal seat edge, the method comprising the steps of:

for a pre-assembled state of the two components placing the concave zone directly against the seal seat edge for centering the fuel injector with respect to the cylinder head, and when putting the fuel injector and cylinder head into an assembled state, impressing at least one section of the concave zone in the seal seat edge by an at least elastic deformation of the material of the cylinder head wherein the fuel injector and cylinder head thus form a fluid-tight seal.

18. The fuel injector according to claim 15, wherein the fuel injector is a diesel pump-nozzle injector.

19. A nozzle retaining nut for a fuel injector, the nozzle retaining nut comprising a sealing area for fluid-tight sealing with respect to a seal seat edge of a cylinder head, wherein the sealing area comprises a concave zone with a radial, circumferential, concave outer contour operable to directly abut against the seal seat edge.

20. The nozzle retaining nut according to claim 19, wherein the concave zone is configured with a completely circumferential concave chamfer and a tapered zone disposed in a radial direction adjoins the concave zone.

* * * * *